US008807113B2

(12) United States Patent
Cassell, Jr. et al.

(10) Patent No.: US 8,807,113 B2
(45) Date of Patent: Aug. 19, 2014

(54) DEVICE AND METHOD FOR INTEGRATING AN AIR CLEANER INTO A RADIATOR FAN SHROUD

(75) Inventors: Hovie Jarrett Cassell, Jr., Piedmont, SC (US); Roger Joseph Khami, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 533 days.

(21) Appl. No.: 12/435,387

(22) Filed: May 4, 2009

(65) Prior Publication Data

US 2010/0275862 A1 Nov. 4, 2010

(51) Int. Cl.
*F01P 9/04* (2006.01)
*F02M 35/02* (2006.01)
*F02M 35/10* (2006.01)

(52) U.S. Cl.
USPC ..... 123/198 E; 123/41.56; 123/41.57; 180/68.1; 180/68.3

(58) Field of Classification Search
USPC ..... 123/198 E, 41.56, 41.57, 184.57; 180/68.1–68.6
See application file for complete search history.

(56) References Cited

U.S. PATENT DOCUMENTS

| | | | | |
|---|---|---|---|---|
| 4,589,379 | A * | 5/1986 | Fujikawa et al. | 123/41.49 |
| 4,641,610 | A | 2/1987 | Rutschmann | |
| 4,736,727 | A * | 4/1988 | Williams | 123/563 |
| 5,056,472 | A | 10/1991 | Kurokawa et al. | |
| 5,136,988 | A | 8/1992 | Frohberg et al. | |
| 5,492,167 | A * | 2/1996 | Glesmann | 165/41 |
| 6,041,744 | A * | 3/2000 | Oota et al. | 123/41.49 |
| 6,499,956 | B2 * | 12/2002 | Nakamura | 416/189 |
| 6,523,507 | B2 * | 2/2003 | Schmitz et al. | 123/41.55 |
| 6,622,668 | B2 * | 9/2003 | Izumi | 123/41.49 |
| 6,691,665 | B2 * | 2/2004 | Gray et al. | 123/192.1 |
| 6,725,905 | B2 * | 4/2004 | Hirano et al. | 165/51 |
| 6,755,169 | B2 | 6/2004 | Storz | |
| 6,928,973 | B2 * | 8/2005 | Suzuki | 123/142.5 R |
| 7,011,079 | B2 * | 3/2006 | Park | 123/559.1 |
| 7,263,962 | B2 * | 9/2007 | Ohara | 123/184.57 |
| 7,278,504 | B2 * | 10/2007 | Smith et al. | 180/68.3 |
| 7,383,810 | B1 * | 6/2008 | Emley | 123/198 E |
| 7,682,413 | B2 * | 3/2010 | Sheidler | 55/345 |
| 8,137,425 | B2 * | 3/2012 | Saito et al. | 55/385.3 |
| 2008/0078525 | A1 * | 4/2008 | Adamson et al. | 165/44 |
| 2008/0289796 | A1 * | 11/2008 | Sasano et al. | 165/51 |
| 2008/0314357 | A1 * | 12/2008 | Sasano et al. | 123/198 E |

FOREIGN PATENT DOCUMENTS

| | | | |
|---|---|---|---|
| FR | 2902153 | A1 * | 12/2007 |
| JP | 7-42567 | | 2/1995 |
| WO | WO 0023696 | A1 * | 4/2000 |

* cited by examiner

*Primary Examiner* — Noah Kamen
*Assistant Examiner* — Grant Moubry
(74) *Attorney, Agent, or Firm* — Jones Robb PLLC; Greg P. Brown

(57) ABSTRACT

An air induction device for a vehicle comprises an air cleaner integrated into a radiator fan shroud; an air inlet configured to direct air into the air cleaner; and an air outlet configured to receive air from the air cleaner for distribution to an engine of the vehicle.

17 Claims, 7 Drawing Sheets

DEVICE AND METHOD FOR INTEGRATING AN AIR CLEANER INTO A RADIATOR FAN SHROUD

INTRODUCTION

The present teachings relate generally to reserving under hood space for a vehicle air cleaner. The present teachings relate more specifically to a device and method for integrating a vehicle's air intake chamber, or air cleaner, into the vehicle's radiator fan shroud.

BACKGROUND

Internal combustion gasoline engines run on a mixture of gasoline and air. Air enters the engine through an air intake chamber, otherwise referred to as an air cleaner or airbox, and proceeds through a series of tubes to the throttle body. The air is then distributed through a series of passages called the intake manifold, where it is circulated to the cylinders. An engine requires air mixed with gasoline (a typical mixture being approximately 14.7 parts of air to one part of gasoline). Accordingly, an engine's horsepower can be limited by the difficulty of getting enough air to the cylinders. It is, therefore, advantageous to limit any air flow restrictions when designing a vehicle's air induction system.

The air cleaner itself is significant not only for air intake, but also as a resonator (e.g., a Helmholtz resonator). A resonance effect occurs when an enclosed volume of a suitable size and shape is connected to the engine's intake manifold, causing the air inside to resonate at a frequency that results in pressure peaks coincident with the cylinders' intake stroke frequency. The system acoustically cancels sound pressure waves to achieve and maintain resonance characteristics. To achieve and maintain these resonance characteristics, it can be advantageous to design an air cleaner of a suitable acoustic volume.

The air cleaner, however, is typically among the last components designed into a vehicle's engine compartment. In order to utilize the minimal remaining space, engineers are typically required to design an air cleaner for each particular vehicle and engine combination. Accordingly, air cleaners are typically engine-mounted or body-mounted where space permits, which generally necessitates a complex piping scheme to route filtered air from the air cleaner into the engine. Turbocharged engines can further complicate air intake placement and piping due to the additional piping required to route filtered air from the air cleaner into the turbochargers and compressed air from the turbochargers to the engine via a charge air cooler. Similar concerns exist for supercharged engines. Such time, space, and design limitations can result in significant setbacks in air flow restriction and air cleaner acoustic volume, as well as additional trade-offs in air charge temperature and air cleaner serviceability.

SUMMARY

In accordance with certain embodiments, the present teaching provide an air induction device for a vehicle, the device comprising: an air cleaner integrated into a radiator fan shroud; an air inlet configured to direct air into the air cleaner; and an air outlet configured to receive air from the air cleaner for distribution to an engine of the vehicle.

Certain embodiments of the present teachings also provide an air induction assembly comprising: a radiator fan shroud including first and second air cleaners, the first air cleaner being substantially vertically positioned along a right side of the radiator fan shroud and the second air cleaner being substantially vertically positioned along a left side of the radiator fan shroud.

Certain embodiments of the present teachings further provide a method for minimizing the required piping necessary to accommodate an air induction system of an engine, the method comprising: incorporating an air cleaner into a radiator fan shroud; providing air to the air cleaner; and providing an air outlet configured to receive air from the air cleaner and distribute the air to the engine.

It is to be understood that both the foregoing general description and the following detailed description are exemplary and explanatory only and are not restrictive of the present teachings, as claimed.

The accompanying drawings, which are incorporated in and constitute a part of this specification, illustrate embodiments of the present teachings and, together with the description, serve to explain the principles of the present teachings.

BRIEF DESCRIPTION OF THE DRAWINGS

At least some features and advantages will be apparent from the following detailed description of embodiments consistent therewith, which description should be considered with reference to the accompanying drawings, wherein.

Although the following detailed description makes reference to illustrative embodiments, many alternatives, modifications, and variations thereof will be apparent to those skilled in the art. Accordingly, it is intended that the claimed subject matter be viewed broadly.

DESCRIPTION OF THE EMBODIMENTS

Reference will now be made in detail to various embodiments, examples of which are illustrated in the accompanying drawings. However, these various exemplary embodiments are not intended to limit the disclosure. To the contrary, the disclosure is intended to cover alternatives, modifications, and equivalents.

Integration of a vehicle's air cleaner into the sides of the vehicle's radiator fan shroud can pre-define and reserve an appropriate amount of under-hood space for the air cleaner and serve to minimize the required piping necessary to accommodate an engine's air induction system. Incorporating an air cleaner into a side of a radiator fan shroud can enable the air cleaner to utilize a universally unexploited space to either side of the radiator fan, providing a standard location of suitable size and shape for the air cleaner in the engine compartment. Engineers can further rely on this predefined space for acoustic purposes, because the reserved volume is also suitable for improving Noise, Vibration and Harshness (NVH). Moreover, when positioned adjacent to the radiator fan, the air cleaner is in a favorable location for distributing clean air to turbochargers of a turbocharged engine, or directly to the throttle body of a naturally aspirated engine). This location serves to minimize the piping required to route the filtered air to the engine, thereby reducing air flow restrictions created by complex piping systems. The present teachings also contemplate embodiments that minimize flow restriction for an engine utilizing a supercharger rather than a turbocharger.

Furthermore, this standard location can provide a convenient access point for servicing the air cleaner and routine maintenance, such as air filter replacement.

To integrate an air cleaner into a radiator fan shroud, exemplary embodiments of the present teachings contemplate incorporating at least one air cleaner into a side of the radiator fan shroud so that, when affixed to a radiator, the air cleaner is substantially vertically positioned adjacent to the radiator fan. Substantially vertically positioned, as used herein, includes an elongated air cleaner extending vertically in the engine compartment or at an angle and or shape such that it can accommodate substantially horizontal piping of clean air to a turbocharger in a turbocharged engine, to a supercharger in a supercharged engine, and to a throttle body in a naturally aspirated engine. Substantially horizontal piping, as used herein, includes piping that is horizontal within the engine compartment or at a slight angle to the horizontal such that it limits air flow restrictions.

Figure 1:
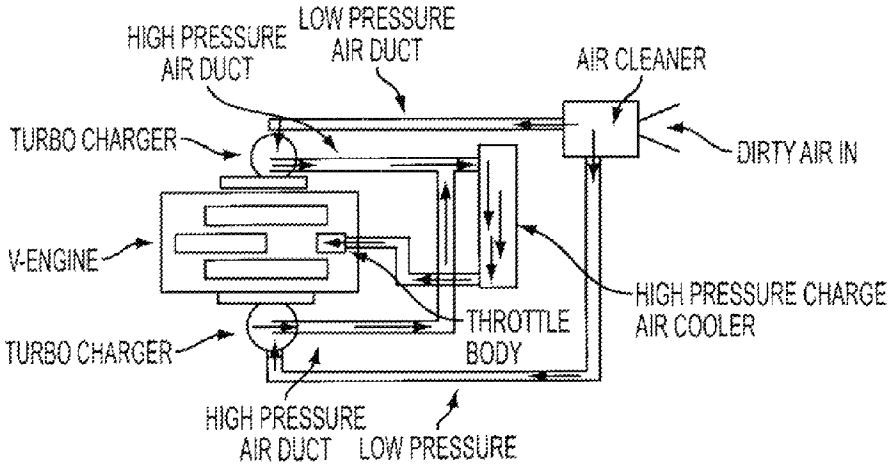
FIG. 1 (PRIOR ART)
FIG. 1 is a diagram showing the typical air flow through a twin turbo charged V-engine.

FIG. 1 is a diagram showing the conventional air flow through a twin turbo charged V-engine. Turbocharged engines have traditionally required the most complex and specific air induction designs, to accommodate the additional piping required to route filtered air from an air cleaner into the turbochargers, and compressed air from the turbochargers into the engine via a charge air cooler. In addition, turbochargers generally have a geographically low position in the engine compartment, and air cleaners generally have a geographically high position in the engine compartment. This necessitates piping filtered air down from a body-mounted or engine-mounted air cleaner through a low pressure air duct into each turbocharger. Hot, compressed air is then piped from each turbocharger through a high pressure air duct into a high pressure charge air cooler. Cool, compressed air is then piped back up to the throttle body for distribution to the engine.

Figure 2:
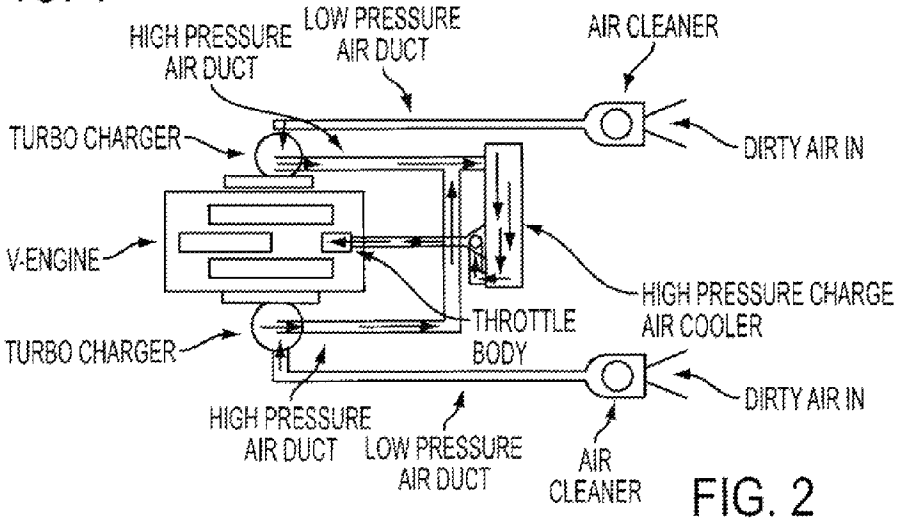
FIG. 2 is a diagram showing the air flow through a twin turbo charged V-engine in accordance with exemplary embodiments of the present teachings.

FIG. 2 is a diagram showing the air flow through a twin turbo charged V-engine in accordance with exemplary embodiments of the present teachings. The air filters shown are substantially vertically oriented within the vehicle engine compartment. Due to the vertical orientation of the air cleaners, filtered air can be piped directly from each air cleaner to each turbocharger through a relatively horizontal low pressure duct even when the turbochargers have a geographically low position in the engine compartment. Hot, compressed air can be piped from each turbocharger through a high pressure air duct into a high pressure charge air cooler. Cool, compressed air can then be piped up around the radiator fan to the throttle body.

Figure 3:
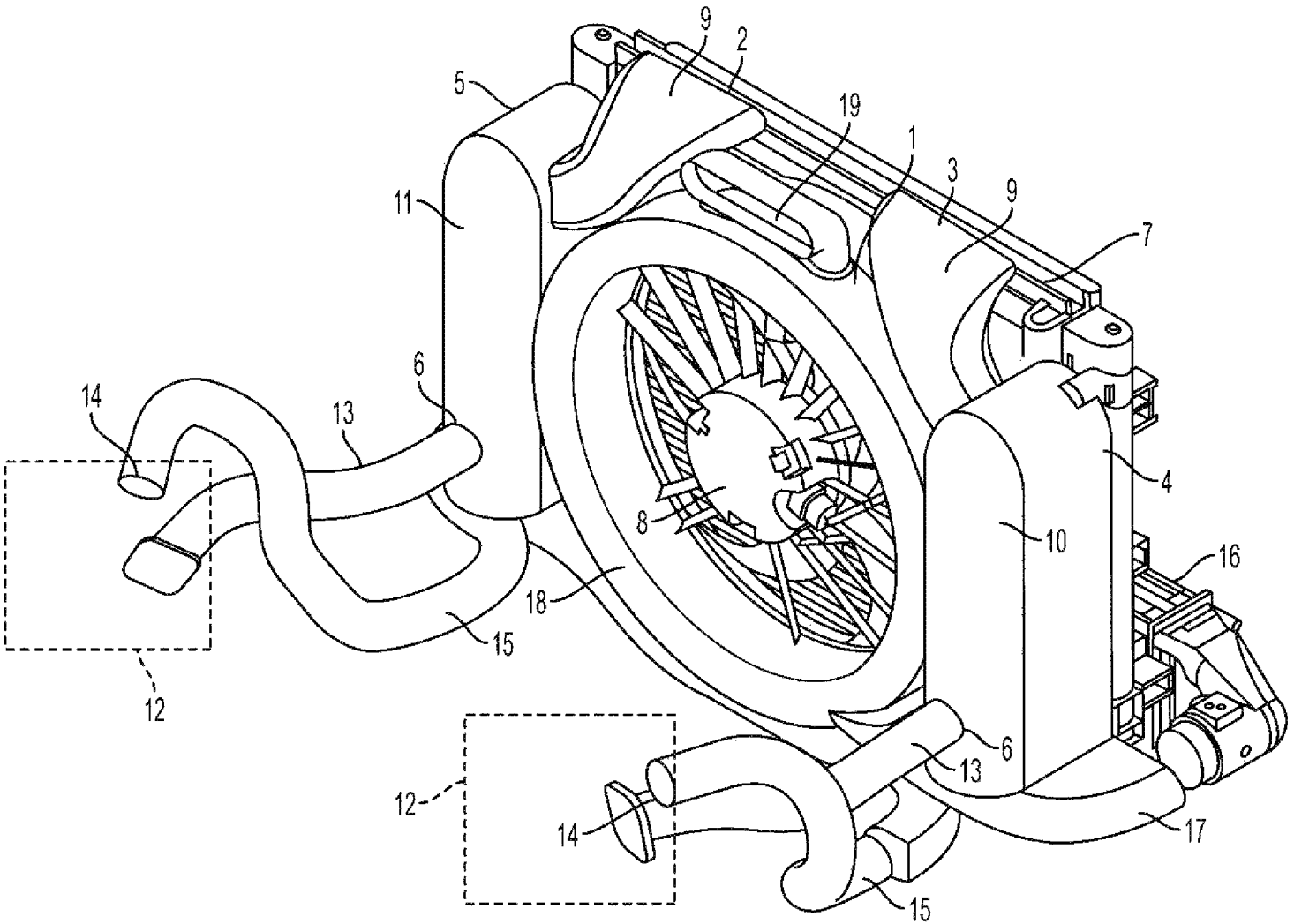
FIG. 3 is a perspective view of an air induction assembly in accordance with exemplary embodiments of the present teachings, as applied in the twin turbo charged V-engine.

FIG. 3 shows a perspective view of an exemplary embodiment of an air induction assembly in accordance with certain aspects of the present teachings as applied, for example, in a twin turbo charged V-engine. A radiator fan shroud 1 includes a right air cleaner 4 and a left air cleaner 5. The right air cleaner 4 is positioned along a right side of the radiator fan shroud 1, and the left air cleaner 5 is positioned along a left side of the radiator fan shroud 1. When the radiator fan shroud 1 is affixed to a radiator 7, air cleaners 4 and 5 are vertically positioned on either side of a radiator fan 8 and are substantially vertically oriented within the vehicle's engine compartment.

The radiator fan shroud 1 may be made of a variety of different materials and by a variety of different methods such as, for example, blow molded plastic, injection molded plastic, and/or sheet metal. The material can be fastened in a variety of ways, including via adhesives, fasteners such as screws or rivets, welding, and/or snapping. The radiator fan shroud 1 may include any suitable solid material that can be used to integrate an air cleaner into to the fan shroud, as would be understood by one skilled in the art.

In certain embodiments of the present teachings, the right air cleaner 4 and the left air cleaner 5, respectively, comprise a right filter cavity 10 and a left filter cavity 11. The filter cavities 10 and 11 can each retain a volume that, when combined is suitable for NVH acoustics. Certain embodiments of the present teachings contemplate the right filter cavity 10 having, for example, a 5 liter volume and the left filter cavity 11 having, for example, a 5 liter volume, for a combined volume of 10 liters (to accommodate, for example, a typical V-8 engine). The present teachings contemplate filter cavities of other suitable volume combinations to accommodate V-8 engines and other engine types as would be understood by those skilled in the art. If the vehicle is equipped with a 4-cylinder engine, for example, the pumping pulsations (a source of NVH) are higher, and a more significant resonator may be required. Accordingly, in certain additional embodiments of the present teachings, an air cleaner 4 or 5 may be replaced with a resonator (see FIG. 6) so that one of the cavities 10, 11 houses the air cleaner, and the other cavity houses the resonator. The air cleaner can comprise a filter cavity with a volume suitable for NVH acoustics such as, for example, 10 liters.

Figure 7:
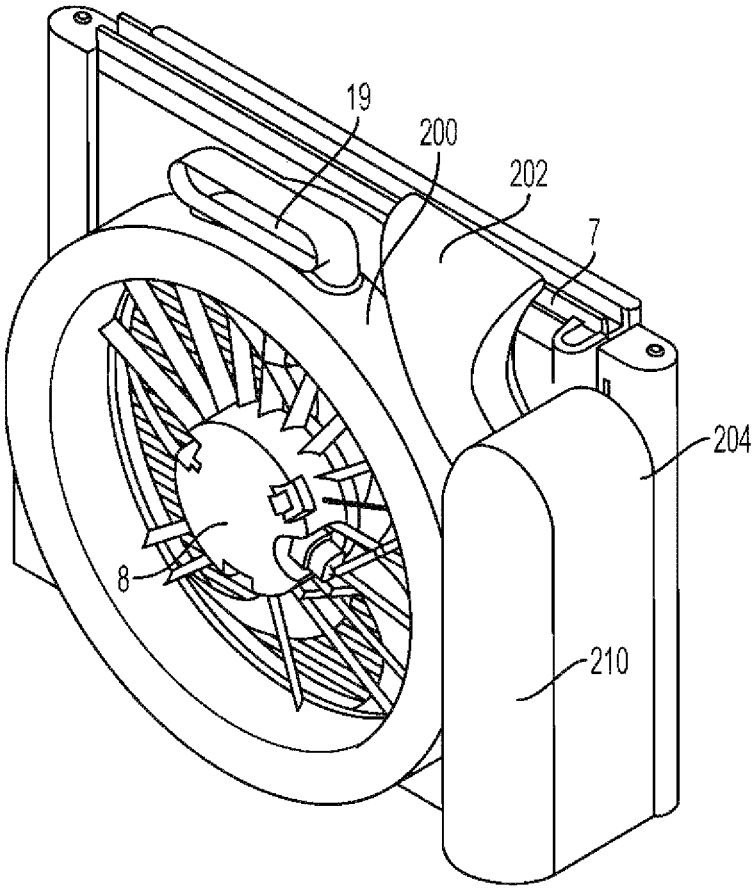
FIG. 7 is an additional view of an air induction assembly in accordance with exemplary embodiments of the present teachings, as applied in a naturally aspirated engine.

Various other exemplary embodiments of the present teachings contemplate combining air cleaners 4 and 5 into one air cleaner integrated into one side of the radiator fan shroud 1 (see FIG. 7). The air cleaner can comprise a filter cavity of a volume suitable for NVH acoustics. For example, two 5-liter filter cavities can be combined into one filter cavity having a 10-liter volume.

As illustrated in FIG. 3, a left scoop 2 and a right scoop 3 supply dirty air from outside a vehicle to the air cleaners 4 and 5. In certain embodiments of the present teachings, scoops 2 and 3 are top-mounted to each respective air cleaner 4 and 5, in order to minimize the length of a stack 9 that directs air from the scoop to the air cleaner. Those skilled in the art will understand, however, that the type, number and positioning of the scoops 2 and 3 depicted in FIG. 3 are exemplary only and non-limiting of the present teachings, and that a variety of dirty air inlet types, sizes, positions and/or numbers are envisioned without departing from the scope of the present teachings. For example, various embodiments of the present teachings consider a dirty air inlet protruding from the hood of a vehicle (such as a traditional air intake scoop), while additional embodiments contemplate a dirty air inlet located in the front grill and/or under the front bumper of the vehicle.

Dirty air is circulated through the filter cavities 10 and 11, where it can pass through air filter elements. Certain embodiments of the present teachings contemplate utilizing air filter elements of a conventional shape and design, including flat/ panel, oval, and cylindrical air filter elements, whereas various additional embodiments of the present teachings contemplate utilizing air filter elements having varied shapes and sizes that accommodate the shape and size of air cleaners 4 and 5 in which they are to be housed.

Filtered air exits the air cleaners 4 and 5 via clean air outlets 6, and is circulated to turbochargers 12 via low pressure air ducts 13. In certain embodiments of the present teachings, the clean air outlets 6 can be positioned at a base of the air cleaners 4 and 5 to minimize air flow restrictions by decreasing the length and cross section of the ducting to the turbochargers 12 and/or the number of necessary bends in the ducting to the turbochargers 12. The turbochargers 12 compress the clean air, thereby also increasing its temperature. The clean, hot, charged air exits the turbochargers 12 via high pressure air outlets 14, and is circulated to a charge air cooler 16 via high pressure air ducts 15. The charge air cooler 16 does not need to be under or in front of the fan shroud. In various embodiments of the present teachings, the high pressure air outlets 14 can be positioned to minimize a high pressure duct length to the charge air cooler 16. Clean, cool charged air exits the charge air cooler 16 via a cooled air outlet 17, and in the illustrated embodiment is channeled around the radiator fan 8 via a circular duct 18 that can be integrated into the radiator fan shroud by, for example, blow molding, injection molding, or welding. The circular duct 18 serves to allow passage of air to a clean, charged air outlet 19 that sends air to the throttle body. In certain embodiments, the cooled air outlet 17 can be positioned directly below and air cleaner, for example the right air cleaner 4. In the illustrated exemplary embodiment, the clean, charged air outlet 19 can be positioned at the top-center of the radiator fan shroud 1 to minimize a duct length to a throttle body.

Figure 4:
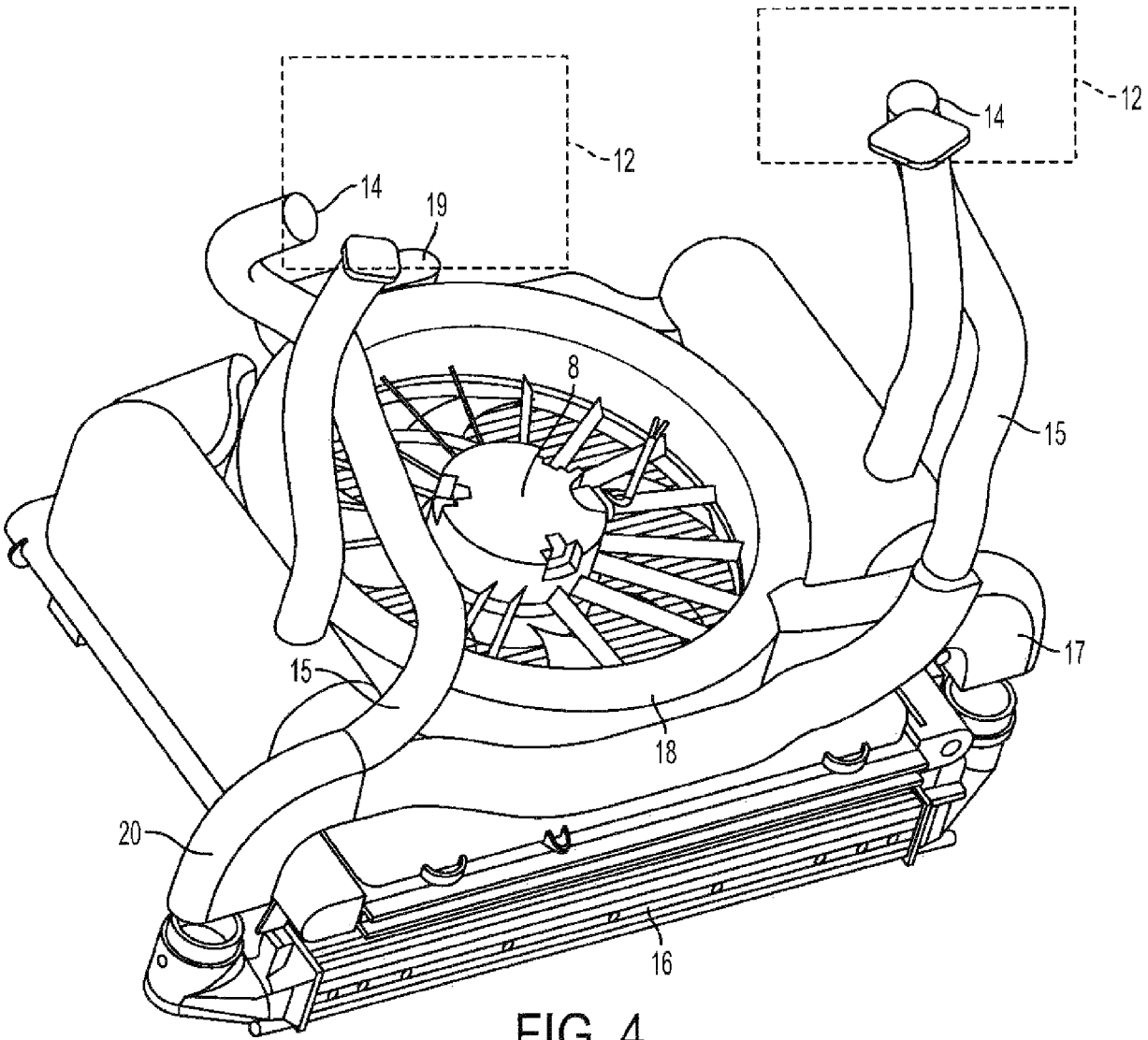
FIG. 4 is a rotated view of the air induction assembly of FIG. 3.

FIG. 4 is a rotated view of the air induction assembly of FIG. 3, showing the charge air cooler 16. In the illustrated exemplary embodiment, clean, hot, charged air exits the turbochargers 12 via the high pressure air outlets 14, and is circulated to the charge air cooler 16 via high pressure air ducts 15. The clean, hot, charged air enters the charge air cooler 16 through a hot air inlet 20, and clean, cool charged air exits the charge air cooler 16 through the cooled air outlet 17. The clean, cool charged air can be channeled around the radiator fan 8 via the circular duct 18 to the clean, charged air outlet 19.

Figure 5:
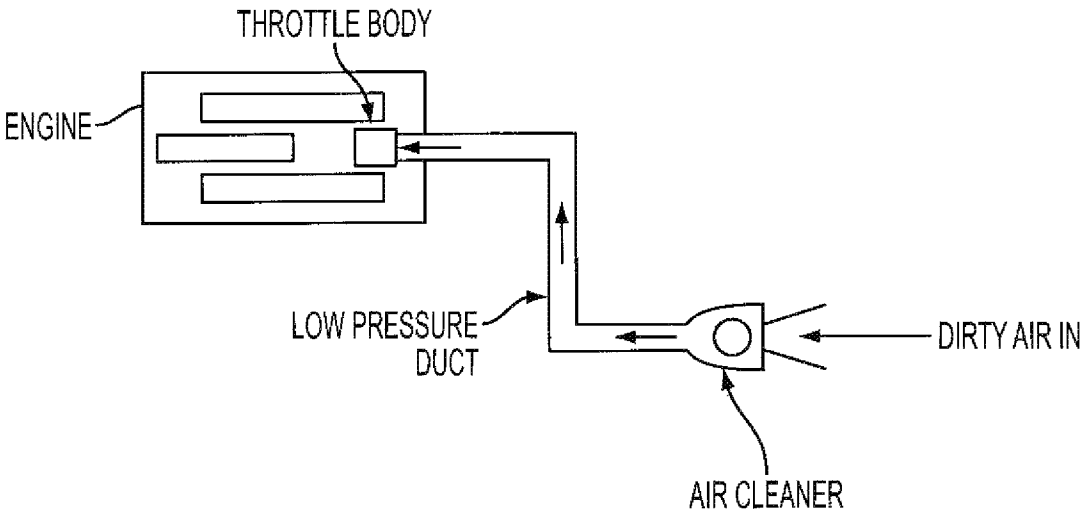
FIG. 5 is a diagram showing the air flow through a naturally aspirated 4-cylinder engine in accordance with exemplary embodiments of the present teachings.

FIG. 5 is a diagram showing the air flow through a naturally aspirated engine, for example a 4-cylinder engine needing only a single air cleaner, in accordance with exemplary embodiments of the present teachings. Due to the positioning of the air cleaner in the engine compartment, filtered air can be piped directly from the air cleaner to the throttle body through a relatively horizontal low pressure air duct by positioning the air outlet at a vertical position on the air cleaner that is in substantially the same horizontal plane as the throttle body inlet.

Figure 6:
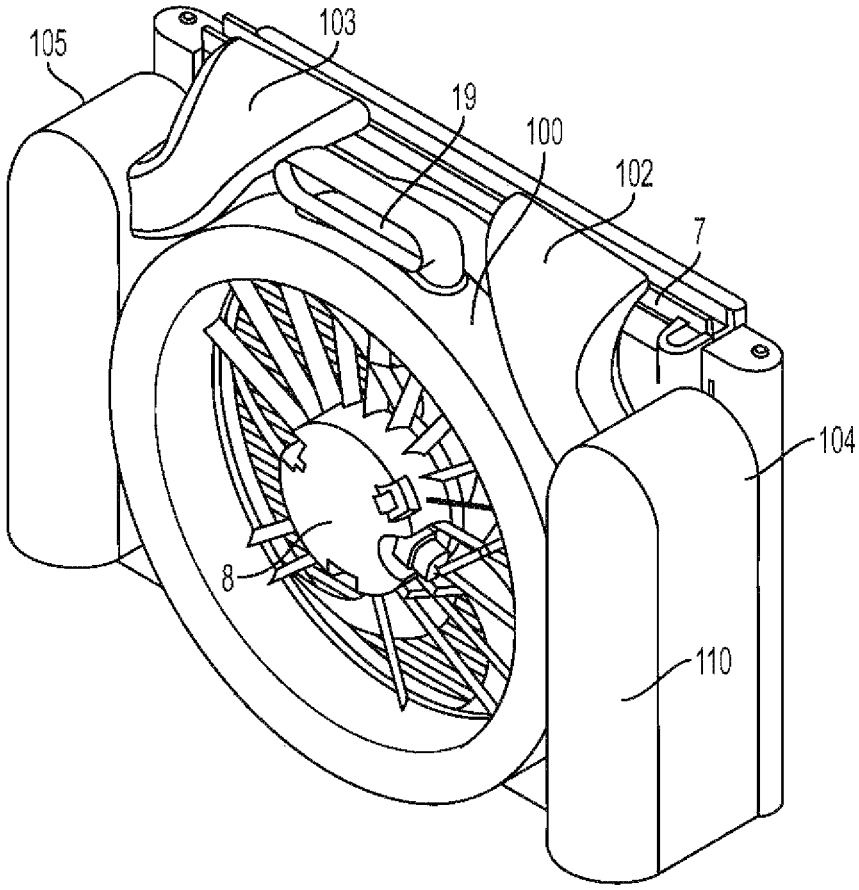
FIG. 6 is a perspective view of an air induction assembly in accordance with exemplary embodiments of the present teachings, as applied in a naturally aspirated engine.

FIG. 6 shows a perspective view of an air induction assembly in accordance with additional exemplary embodiments of the present teachings, as applied in a naturally aspirated engine, such as a V-type engine, for example a 4-cylinder V-type engine. In circumstances where sound propagation is high, for example, in a vehicle equipped with a 4-cylinder engine, a resonator 105 can be used to complement the acoustics provided by an air cleaner 104 in a manner that would be understood by those skilled in the art. Accordingly, a radiator fan shroud 100 can include the air cleaner 104 on one side and the resonator 105 on the other side. In certain embodiments of the present teachings, the air cleaner 104 is positioned along a right side of the radiator fan shroud 100 and the resonator 105 is positioned along a left side of the radiator fan shroud 100, where in other embodiments the air cleaner 104 is positioned along the left side of the radiator fan shroud 100 and the resonator 105 is positioned along the right side of the radiator fan shroud 100. When the radiator fan shroud 100 is affixed to a radiator 7, the air cleaner 104 and the resonator 105 are vertically positioned on either side of a radiator fan 8.

In accordance with various embodiments of the present teachings the air cleaner 104 comprises a filter cavity 110 of a volume suitable for NVH acoustics, such as, for example, 10 or 12 liters. Further embodiments of the present teachings contemplate filter cavities of other suitable volumes to accommodate a variety of engine types and sizes. Dirty air inlets 102 and 103 supply dirty air from outside a vehicle to the air cleaner 104 and the resonator 105, respectively. Those skilled in the art will understand that the type, size, number and positioning of the dirty air inlets 102 and 103 depicted in FIG. 6 are exemplary only and non-limiting of the present teachings, and that a variety of different types of dirty air inlets, positions and/or numbers are envisioned without departing from the scope of the present teachings. In accordance with certain embodiments of the present teachings, the air inlets 102 and 103 can be located just under the vehicle hood. In various embodiments, the air inlet 102 and 103 cab me greater than or equal to 700 millimeters from the road surface.

Dirty air from inlet 102 is circulated through a filter cavity 110, where it can pass through an air filter element. Filtered air can exit the air cleaner 104 to be circulated to a throttle body via low pressure duct connected to a clean air outlet 19. The clean air outlet 19 can be positioned at a position high on the air cleaner 104 to minimize air flow restrictions by decreasing the length and cross section of the ducting to the throttle body and/or the number of necessary bends in the ducting to the throttle body.

FIG. 7 shows a perspective view of an air induction assembly in accordance with another exemplary embodiment of the present teachings, as applied in a naturally aspirated engine that does not necessitate the additional ducting required to pipe filtered air through turbochargers and a charge air cooler before it reaches the throttle body. A radiator fan shroud 200 can include an air cleaner 204. In certain embodiments of the present teachings, the air cleaner 204 is positioned substantially vertically along a right side of the radiator fan shroud 100, where in other embodiments the air cleaner 204 is positioned substantially vertically along a left side of the radiator fan shroud 200 or along a top of the radiator fan shroud 200.

The illustrated air cleaner 204 comprises a filter cavity 210 of a volume suitable for NVH acoustics, such as, for example, 10 or 12 liters. Further embodiments of the present teachings contemplate filter cavities of other suitable volumes to accommodate all engine types and sizes. Dirty air inlet 202 supplies dirty air from outside a vehicle to the air cleaner 204. Those skilled in the art will understand that the type, size and positioning of the dirty air inlet 202 depicted in FIG. 7 is exemplary only and non-limiting of the present teachings, and that a variety of different types of one or more dirty air inlets can be employed without departing from the scope of the present teachings.

The dirty air is circulated through a filter cavity 210, where it can pass through an air filter. Filtered air exits the air cleaner 204 via clean air outlet 19, and is circulated to a throttle body via a low pressure air duct (not shown). The clean air outlet 19 can be positioned at a position high on the air cleaner 204 to minimize air flow restrictions by decreasing the length and cross section of the ducting to the throttle body and/or the number of necessary bends in the ducting to the throttle body.

Figure 8:
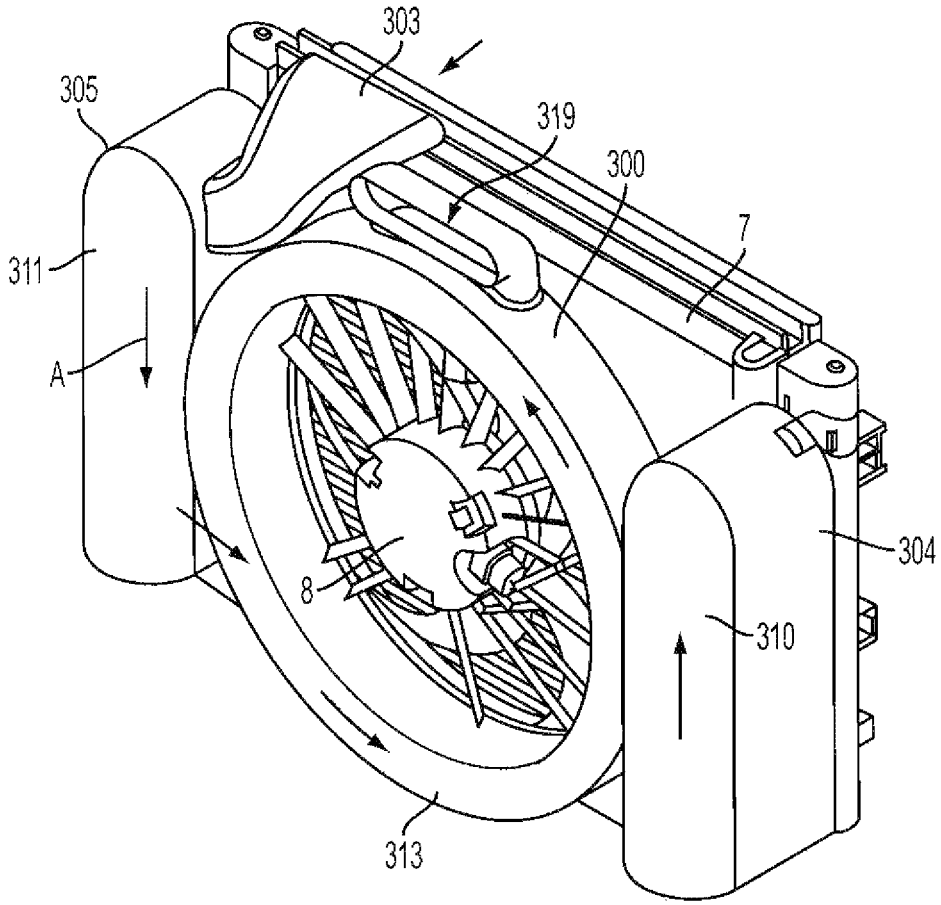
FIG. 8 is a further view of an air induction assembly in accordance with exemplary embodiments of the present teachings, as applied in a naturally aspirated engine.

FIG. 8 shows a perspective view of an air induction assembly in accordance with an exemplary embodiment of the present teachings as applied in a naturally aspirated engine. The illustrated radiator fan shroud 300 includes two air cleaners, illustrated as a right air cleaner 304 and a left air cleaner 305. The right air cleaner 304 is positioned along a right side of the radiator fan shroud 300, and the left air cleaner 305 is positioned along a left side of the radiator fan shroud 300. When the radiator fan shroud 300 is affixed to a radiator 7, air cleaners 304 and 305 are vertically positioned on either side of a radiator fan 8 and are substantially vertically oriented within the vehicle's engine compartment.

In certain embodiments of the present teachings, the right air cleaner 304 and the left air cleaner 305, respectively, comprise a right filter cavity 310 and a left filter cavity 311. Filter cavities 310 and 311 can each retain a volume that, when combined, is suitable for NVH acoustics.

As illustrated by counterclockwise arrows A in FIG. 8, a dirty air inlet 303 supplies dirty air from outside a vehicle to the air cleaner 305. Those skilled in the art will understand that the type, number and positioning of the dirty air inlet 303 depicted in FIG. 8 is exemplary only and non-limiting of the present teachings, and that a variety of dirty air inlet types, sizes, positions and/or numbers are envisioned without departing from the scope of the present teachings.

As further shown by the counterclockwise arrows A, dirty air is circulated through the filter cavity 311, where it can pass through a first air filter. Semi-filtered or coarse-filtered air exits the air cleaner 305 via a clean air outlet, and is channeled under the radiator fan 8 via a circular low pressure duct 313 to the air cleaner 304. The semi-filtered (or coarse-filtered) air is circulated through the filter cavity 310, where it can pass through a second air filter. Filtered air exits the air cleaner 304 via a clean air outlet, and is channeled above the radiator fan shroud 8 via the circular low pressure duct 313 to an air outlet 319 that sends air to a throttle body. In the illustrated exemplary embodiment, the air outlet 319 is positioned at the top-center of the radiator fan shroud 300, but can be positioned otherwise as needed to minimize air flow restrictions by decreasing the length and cross section of the ducting to the throttle body and/or the number of necessary bends in the ducting to the throttle body. Air filter 305 can comprise, for example. a foam filter, paper pleats, or a particle separator.

In certain embodiments of the present teachings, an air cleaner 304 or 305 may be replaced with a resonator (see FIG. 6) so that one of the cavities 310, 311 houses the air cleaner, and the other cavity houses the resonator. The air cleaner can comprise a filter cavity with a volume suitable for NVH acoustics.

In snowy climates, there is also a concern of ingesting snow into the air cleaners via the dirty air inlets, which can plug up the filters, resulting in unacceptable flow restriction in the engine. Accordingly, certain embodiments of the present teachings further contemplate running a coolant line from the radiator through each air cleaner to melt ingested snow to defrost the internal volume of the filters. Due to the unique positioning of the air cleaners, heated liquid may be channeled directly from the radiator tank into each filter cavity while the vehicle is running or just when excess backpressure is detected on the engine. In various embodiments of the present teachings, coolant can be circulated through the air cleaners only upon being triggered by a climate control system, temperature gauge, or other logic.

While the present teachings have been disclosed in terms of exemplary embodiments in order to facilitate better understanding of the present teachings, it should be appreciated that the teachings can be embodied in various ways without departing from the principle of the invention. Accordingly, while the present teachings have been disclosed in terms of a turbocharged engine, a supercharged engine, and a naturally aspirated engine, the teachings as disclosed work equally well for other engine types, and are independent of drive type. Therefore, the present teachings should be understood to include all possible embodiments which can be embodied without departing from the principle of the teachings set forth in the appended claims.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the written description and claims are approximations that may vary depending upon the desired properties sought to be obtained by the present teachings. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an air cleaner" includes two or more different air cleaners. As used herein, the term "include" and its grammatical variants are intended to be non-limiting, such that recitation of items in a list is not to the exclusion of other like items that can be substituted or added to the listed items.

It will be apparent to those skilled in the art that various modifications and variations can be made to the system and method of the present disclosure without departing from the scope its teachings. Other embodiments of the disclosure will be apparent to those skilled in the art from consideration of the specification and practice of the teachings disclosed herein. It is intended that the specification and embodiment described herein be considered as exemplary only.

What is claimed is:

1. An air induction device for a vehicle having a turbocharger, the device comprising:

a first air cleaner integrated into a radiator fan shroud, the first air cleaner comprising a filter cavity, the first air cleaner extending substantially vertically along a side of a radiator fan, a circular duct being integrated into the radiator fan shroud, wherein the circular duct is configured to duct air around the radiator fan;

an air inlet located at a top of the air induction device and having a stack configured to direct air into a top portion of the first air cleaner; and a first air outlet configured to receive air from the first air cleaner for distribution to the turbocharger through a substantially horizontal air duct that reduces airflow restrictions between the first air outlet and the turbocharger.

2. The air induction assembly of claim 1, further comprising at least one resonator integrated into the radiator fan shroud.

3. The air induction assembly of claim 2, wherein the at least one resonator extends substantially vertically along a side of the radiator fan opposite the first air cleaner.

4. The air induction assembly of claim 1, further comprising a second air cleaner integrated into the fan shroud and extending substantially vertically along a side of the radiator fan that is opposite the first air cleaner.

5. The air induction assembly of claim 1, wherein the air inlet is mounted at a top portion of the radiator fan shroud.

6. The air induction assembly of claim 1, wherein the first air outlet is positioned at a bottom of the first air cleaner.

7. The air induction assembly of claim 1, wherein the first air outlet is positioned at a top of the first air cleaner.

8. The air induction assembly of claim 1, wherein the turbocharger has a high pressure air outlet providing charged air to a charge air cooler, the high pressure air outlet being positioned to minimize a high pressure duct length to the charge air cooler.

9. The air induction assembly of claim 8, wherein the charged air is ducted around the radiator fan to a charged air outlet.

10. The air induction assembly of claim 9, wherein the charged air outlet is positioned vertically on the radiator fan shroud to minimize flow restrictions to a throttle body.

11. The air induction assembly of claim 1, wherein the circular duct has an annular shape.

12. The air induction assembly of claim 1, wherein the circular duct surrounds the radiator fan.

13. The air induction assembly of claim 1, the radiator fan shroud further comprising an air outlet configured to provide air to an engine, wherein the air outlet is connected to an outlet of the circular duct.

14. An air induction assembly for a vehicle having a turbocharger, the air induction assembly comprising:

a radiator fan shroud including:

first and second integral air cleaners, the first air cleaner extending substantially vertically along a right side of the radiator fan shroud and the second air cleaner extending substantially vertically along a left side of the radiator fan shroud, each air cleaner comprising:

an air inlet, and an air outlet positioned vertically at a base of the air cleaner; and a substantially horizontal air duct connecting each of the air outlets to a turbocharger, the substantially horizontal air duct reducing air flow restriction to the turbocharger.

15. The air induction assembly of claim 14, further comprising a circular duct integrated into the radiator fan shroud.

16. An air induction assembly for an engine having one of a turbocharger and a supercharger, the air induction assembly comprising:

a radiator fan shroud including:

first and second integral air cleaners, the first air cleaner extending substantially vertically along a right side of the radiator fan shroud and the second air cleaner extending substantially vertically along a left side of the radiator fan shroud, an air inlet, and a first air outlet positioned vertically along at least one of the air cleaners;

a substantially horizontal air duct connecting the first air outlet to the turbocharger or supercharger, the substantially horizontal air duct reducing restriction of air flow to the supercharger or turbocharger; and a charge air cooler configured to receive air from the turbocharger or supercharger, wherein cool charged air exits the turbocharger or supercharger via a charged air outlet positioned below one of the first and second air cleaners.

17. The air induction assembly of claim 16, wherein the substantially horizontal air duct connecting the first air outlet to the turbocharger or supercharger directly connects the first air outlet to the turbocharger or supercharger without branches in the substantially horizontal air duct.

* * * * *